US005411139A

United States Patent [19]

Victory

[11] Patent Number: 5,411,139

[45] Date of Patent: May 2, 1995

[54] ORIENTABLE KEYBOX WITH KEYPANELS VERTICALLY AND HORIZONTALLY EXTENDABLE

[76] Inventor: James Victory, 4520 Forest Hill Cir., #13, Fort Worth, Tex. 76140

[21] Appl. No.: 195,816

[22] Filed: Feb. 14, 1994

[51] Int. Cl.[6] ..... A47F 7/00

[52] U.S. Cl. ..... 206/493; 206/526; 211/13; 312/132; 312/321; 312/322

[58] Field of Search ..... 206/493, 526; 312/132, 312/133, 308, 309, 311, 321, 185, 322, 334.4; 211/13

[56] References Cited

U.S. PATENT DOCUMENTS

| | | | |
|---|---|---|---|
| 587,741 | 8/1897 | King | 312/132 |
| 1,742,542 | 1/1930 | Howell | 211/13 |
| 1,770,327 | 7/1930 | Thayer | 206/493 X |
| 2,758,904 | 8/1956 | Hansell et al. | 312/311 X |
| 3,497,074 | 2/1970 | Shaheen | 211/13 |
| 3,664,719 | 5/1972 | Berg | 312/185 |
| 3,813,138 | 5/1974 | Doohan | 312/309 |
| 4,334,620 | 6/1982 | Block | 211/13 |
| 4,854,656 | 8/1989 | O'Keefe | 211/13 X |

*Primary Examiner*—Bryon P. Gehman
*Attorney, Agent, or Firm*—Geoffrey A. Mantooth

[57] ABSTRACT

A keybox capable of being oriented in a horizontal or vertical position is disclosed. Keypanels are maintained in the keybox and may be secured in either a horizontal or vertical extended position for viewing. The keypanels are slidably mounted in grooved tracks thereby being located upright and parallel within the keybox. Upwardly extending keyhooks are located on the keypanels for retaining keys. The keypanels are square so that the keyhooks may be located extending upwardly when the keybox is oriented upwards or sidewards. The keypanels are accessible through an opening in the keybox and may be slid out of the keybox to an extended position through the opening. Each keypanel may be secured in a horizontal extended position on the keybox by locating a lower edge of the keypanel on a shoulder of the keybox and securing the keypanel thereon by locating a retaining bar coupled to the keybox in a notch in an upper edge of the keypanel. Each keypanel may be secured in a vertical extended position by being located on ledges in the grooved tracks adjacent the keybox opening.

11 Claims, 3 Drawing Sheets

FIG. 2
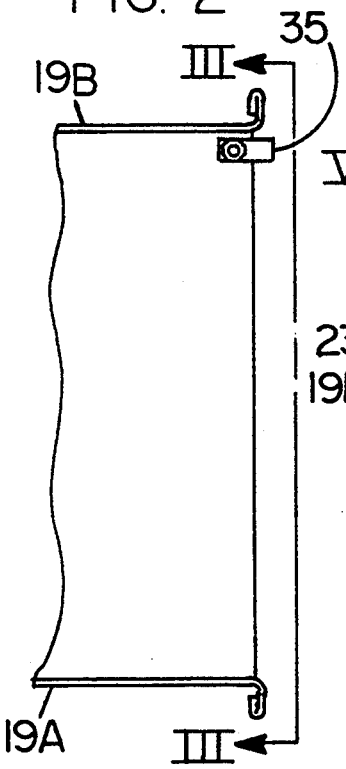
FIG. 3
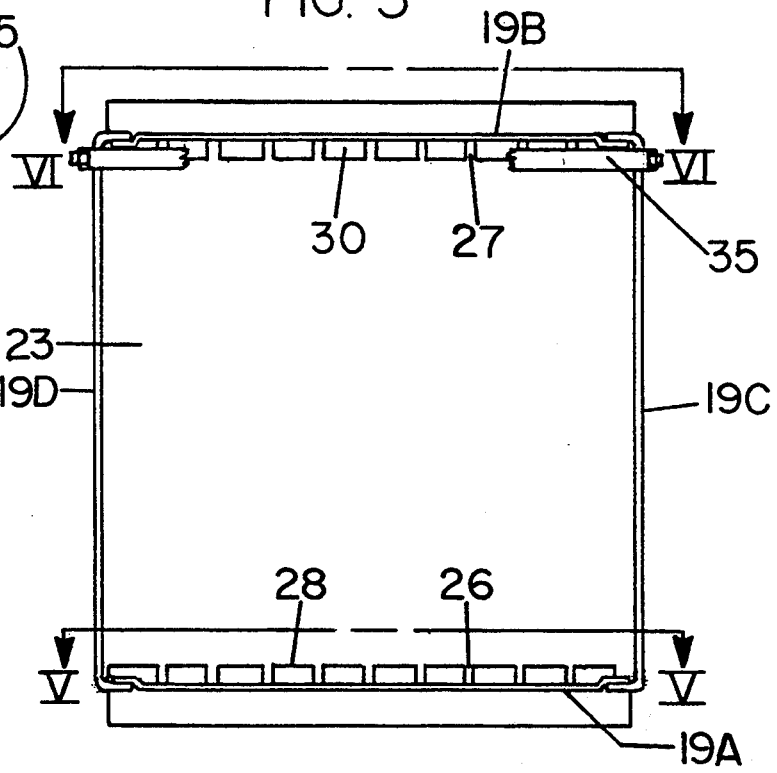
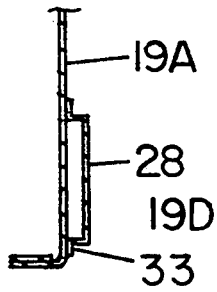
FIG. 4
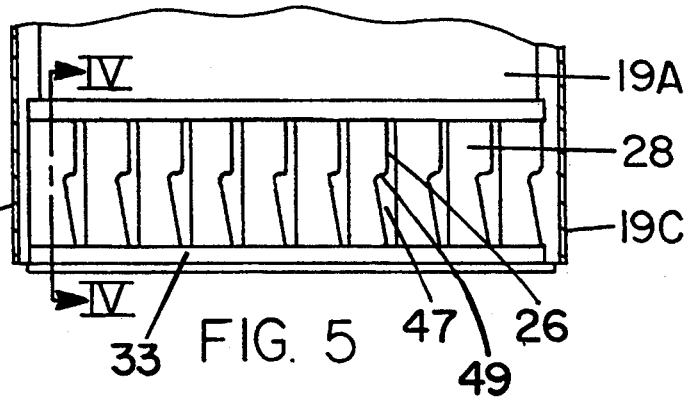
FIG. 5
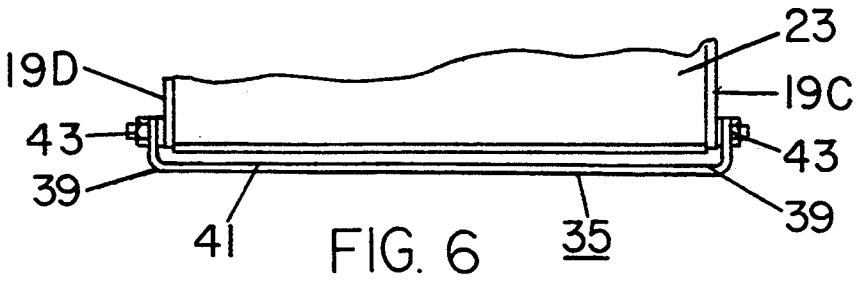
FIG. 6

ORIENTABLE KEYBOX WITH KEYPANELS VERTICALLY AND HORIZONTALLY EXTENDABLE

FIELD OF THE INVENTION

The present invention relates to keyboxes for storing keys, in particular, to a keybox that may be oriented horizontally or vertically.

BACKGROUND OF THE INVENTION

Keyboxes are used by locksmiths to store numerous keys and keyblanks. A keybox provides easy organized access to the keys and keyblanks required by the locksmith. Conventional keyboxes may be transportable so that the keys and keyblanks located therein may be carried to locations where the keys and keyblanks are used.

In a conventional keybox, keys are located on keyhooks which are mounted on keypanels. Several keypanels are located extending upright and parallel to each other in the keybox. The keybox has grooved plates located along opposing walls inside the keybox. The keypanels are held upright within the keybox by grooves in the plates. The keyhooks on the keypanels are located facing upwards so that keys may be retained on the keyhooks. The keypanels may be accessed through an opening at the top of the keybox. The keypanels may be pulled vertically upwards through the grooves out of the opening at the top of the keybox in order to view and access the keys on the keypanels. The keypanels may be supported in a position extending vertically out of the keybox by resting bottom edges of the panels in notches located in the grooves near the top of the keybox. The keys on the vertically extended keypanel are easily viewed. After the keys have been viewed and accessed, the keypanel may be lowered back into the keybox.

Conventional keyboxes can only be oriented so as to be accessed from the top of the keybox because the keypanels are rectangular and may not be oriented in the keybox so that the keyhooks on the keypanels extend upwards when the opening of the keybox is located to the side. Furthermore, a conventional keybox has no means to secure a keypanel in an extended horizontal position. The top-open design of the keybox requires that the keybox be stored so that the keypanels can be vertically raised for viewing. The storage space available for storing the keybox, however, may be more amenable to a sidewards opening keybox capable of securing keypanels in a horizontally extended position for viewing.

SUMMARY OF THE INVENTION

It is therefore, an object of the present invention to provide a keybox having keypanels therein for retaining a plurality of keys, which keybox may be oriented with a keybox opening facing upwards or sidewards, which keypanels of the keybox can be moved to a horizontally extended position if the opening of the keybox faces sidewards and can be moved to a vertically extended position if the opening of the keybox faces upwards.

It is also an object of the invention to provide a method of using a keybox having a sidewards opening.

The keybox apparatus of the present invention includes an open faced box having walls which form a cavity and define an opening that communicates with the cavity. At least one keypanel is removably mounted in a stowed position within the keybox. A plurality of keyhooks are coupled to and extend from each keypanel for retaining keys. A shoulder extends along a wall of the keybox adjacent the opening. The shoulder is structured and arranged to support an edge of a keypanel when the keypanel is located in a horizontally extended position. Means for retaining an edge of a keypanel that is located in a horizontally extended position are coupled to the keybox. The means for retaining an edge of a keypanel are located extending along a wall of the keybox opposite the shoulder.

In one aspect of the invention, each of the keypanels is square. The square keypanels may be mounted in the keybox with the keyhooks of the keypanels extending upwards when the opening of the keybox is located facing upwards as well as when the opening of the keybox is located facing sidewards. Therefore, a keybox containing the square keypanels may be oriented both horizontally and vertically.

With the present invention, a locksmith can locate a keybox in a truck or other storage area having little space. The keybox can be located so that the keypanels therein may be pulled out either vertically or horizontally, whichever is more space efficient. The keypanels may be secured in either an extended horizontal position or an extended vertical position, depending on the orientation of the keybox, thereby freeing the locksmith's hands so that the locksmith is able to quickly locate a desired key. After removing a desired key the locksmith may easily relocate the keypanel within the keybox for storage.

BRIEF DESCRIPTION OF THE DRAWINGS

FIG. 2 is a side view of a front portion of the sidewards facing keybox.

FIG. 3 is a front view of the sidewards facing keybox taken along lines III—III of FIG. 2.

FIG. 4 is a cross-sectional view of the plate located within the keybox taken along lines IV—IV of FIG. 5.

FIG. 5 is a top plan view of a plate located within the keybox taken along lines V—V of FIG. 3.

FIG. 6 is a top plan view of the front portion of the sidewards facing keybox taken along lines VI—VI of FIG. 3 showing the retaining bar.

DESCRIPTION OF THE PREFERRED EMBODIMENT

Figure 1:
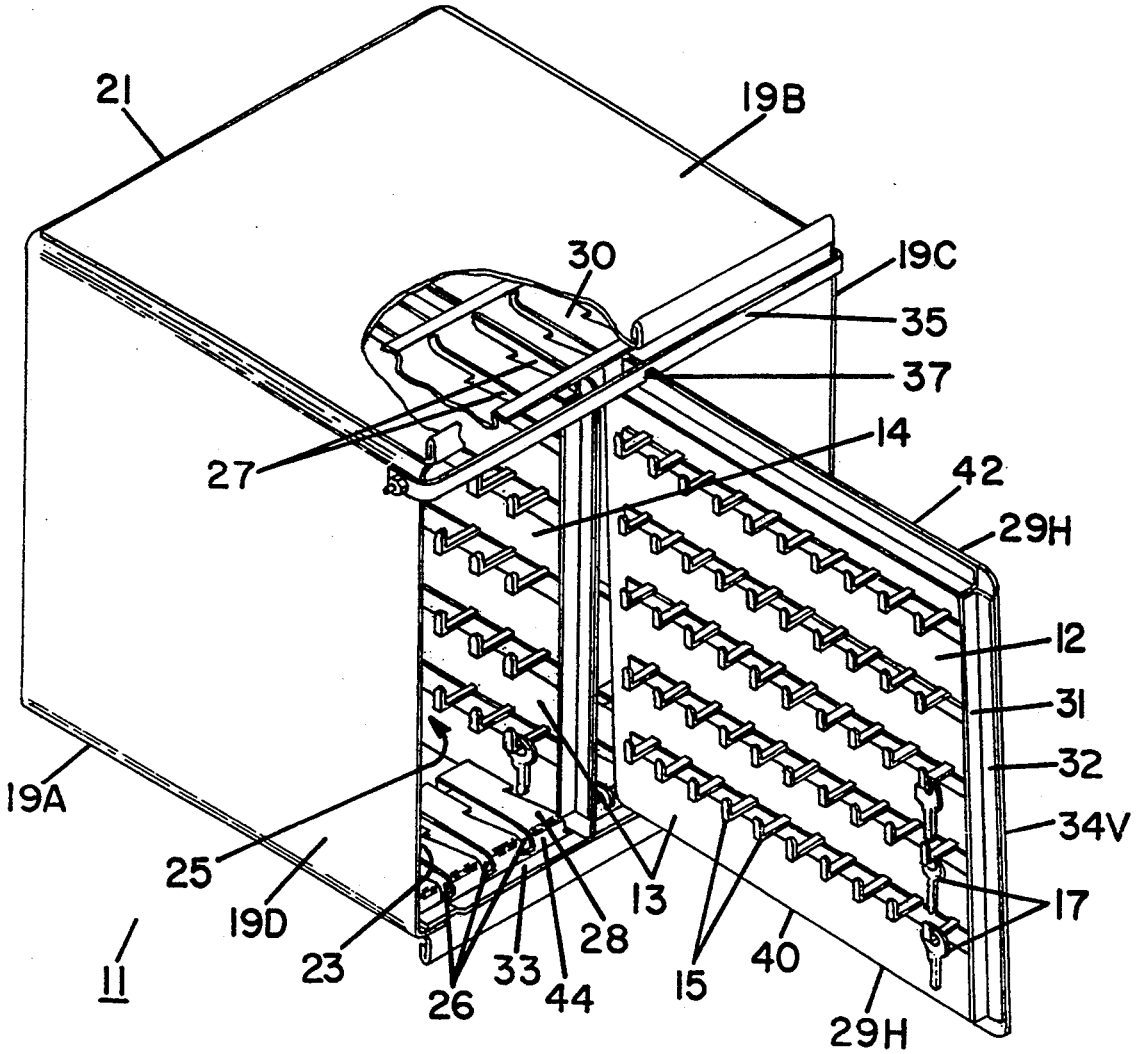
FIG. 1 is a perspective view of the keybox of the present invention, in accordance with a preferred embodiment, located with the opening of the keybox facing sidewards.

Referring now to FIG. 1, a keybox 11 is shown in accordance with the present invention. Several keypanels 13 are mounted inside the keybox 11. Each keypanel 13 has multiple keyhooks 15 extending therefrom on which keys or key blanks 17 may be located. The keyhooks 15 on the keypanels 13 enable the keybox 11 to retain numerous keys 17 within the keybox 11. The keybox 11 may be located in a vehicle so that a locksmith may transport the keybox 11 in order to have instant access to a large number of keys. Alternatively, individual keypanels 13 may be removed from the keybox 11 and transported to a job site.

The keypanels 13 are slidably mounted in the keybox 11 so that each individual keypanel 13 may be pulled out for inspection of the keys 17 located on that keypanel 13. The keypanels 13 may be pulled out to extend vertically (not shown) above the keybox 11, or horizontally adjacent to the keybox 11 as shown in FIG. 1, depending on the orientation of the keybox 11. The keypanels 13 may be secured in either a vertically extended position or a horizontally extended position 12 (see FIG. 1) for ease of viewing the keys 17 located on the keypanels 13. The keypanels 13 may be stored within the keybox 11 in a horizontal stowed position 14 or in a vertical stowed position.

The keybox 11 has side walls 19A–19D and a back wall 21 which are integrally coupled together about the edges of the walls 19A–19D and 21 to form an open box. The walls 19A–19D define an opening 23 into a cavity 25 that is located within the walls 19A–19D and 21 of the keybox 11. The back wall 21 is located opposite the opening 23 in the keybox 11. The keypanels 13 are located within the cavity 25, and may be removed from or inserted into the cavity 25 through the opening 23.

As shown in FIGS. 1 and 3–5, the keypanels 13 are slidably mounted in the keybox 11 in grooved tracks 26 and 27 formed in plates 28 and 30, respectively, located within the keybox 11. The plates 28 and 30 having grooved tracks 26 and 27 therein are mounted on opposing side walls 19A and 19B, respectively, inside the cavity 25 adjacent the opening 23 in the keybox 11. The plates 28 and 30 extend from side wall 19C to side wall 19D along the side walls 19A and 19B, respectively.

Each grooved track 26 and 27 in a plate 28 and 30 extends through the plate from the opening 23 of the keybox 11 towards the back wall 21. Each grooved track 26 is located directly opposite an opposing grooved track 27 located in the plate 30 on the opposing wall 19B so that opposing grooved tracks 26 and 27 form a pair of tracks capable of retaining a keypanel 13 in an upright position within the keybox 11. The pairs of grooved tracks 26 and 27 within the keybox 11 maintain several keypanels 13 in parallel upright positions.

As shown in FIG. 1, in order to mount a keypanel 13 in the keybox 11 opposing edges 29H of the keypanel 13 may be located in a pair of grooved tracks in the plates 28 and 30. The keypanel 13 is sized so that the distance between the opposing edges 29H is slightly smaller than the distance between the walls 19A and 19B, yet is slightly greater than the distance between the plates 28 and 30 so the keypanel slides within the grooves 26 and 27 in the plates. The edges 29H of the keypanel 13 may be moved within the grooved tracks 26 and 27 so that the position of the keypanel 13 within the keybox 11 may be changed by sliding the keypanel 13 along the grooved tracks 26 and 27 in which the keypanel 13 is located. The keypanel 13 is further sized so that when fully inserted into the keybox 11 an edge of the keypanel 32 is located proximate to the opening 23 of the keybox 11.

Figure 7:
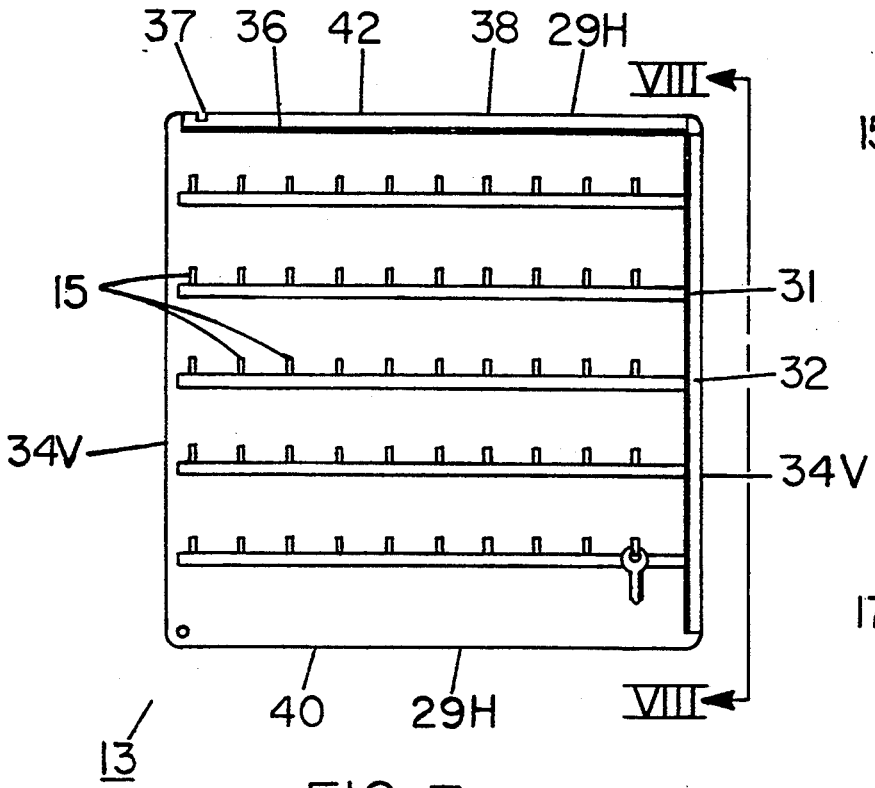
FIG. 7 is a plan view of a keypanel.
Figure 8:
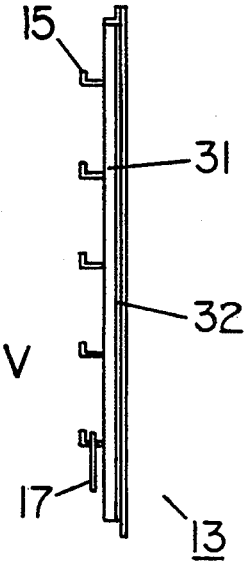
FIG. 8 is a side view of a keypanel.

As shown in FIGS. 7 and 8, in a preferred embodiment each keypanel 13 is square. The square keypanel has two sets of opposing edges 29H and 34V, which slidably fit within the grooved tracks 26 and 27 of the keybox 11. The edges 29H enable the keypanel 13 to slide laterally in the keybox 11 when the opening 23 of the keybox 11 is located facing sideways. Therefore, the keypanel 13 may be disposed horizontally within the keybox 11 with the keyhooks 15 of the keypanel 13 located facing upwards. The edges 34V enable the keypanel 13 to slide vertically in the keybox 11 when the opening 23 of the keybox 11 is located facing upwards. Therefore, the keypanel 13 may also be disposed vertically within the keybox 11 with the keyhooks 15 located facing upwards. Shoulder 31 is located along the edge 32 proximate to the opening 23 when the keypanel 13 is fully inserted horizontally into the keybox 11. Shoulder 36 is located along the edge 38 proximate to the opening 23 when the keypanel 13 is fully inserted vertically into the keybox 11. The shoulders 31 and 36 enable the keypanel 13 to be easily gripped for retraction from or insertion into the keybox 11.

Referring now to FIGS. 1, 3 and 5–7, each keypanel 13 in the horizontally oriented keybox 11 may be located in a stable position extending horizontally out of the keybox 11 so that each keypanel 13 may easily be individually viewed. The keybox 11 has a support shoulder 33 and a retaining bar 35 that cooperatively support the keypanels 13 in a horizontally extended position. The support shoulder 33 supports the bottom edge 40 of an extended keypanel 13 which is located on the support shoulder 33. The retaining bar 35 secures the upper edge 42 of the extended keypanel 13. The support shoulder 33 and the retaining bar 35 are capable of supporting multiple keypanels 13 simultaneously if several keypanels 13 are to be viewed at once.

The support shoulder 33 of the keybox 11 is located along the wall 19A of the keybox 11. The wall 19A along which the support shoulder 33 is located is positioned at the bottom of the horizontally oriented keybox 11. The support shoulder 33 is integrally coupled to the wall 19A and is formed forward of the plate 28. In one embodiment, the shoulder 33 may be formed by the forward edge 44 of the plate 28 and the wall 19A. The support shoulder 33 forms a step-like configuration at the bottom of the opening 23 capable of receiving and supporting a corner of a keypanel 13. The bottom rear corner of a horizontally oriented keypanel 13 is positioned on the support shoulder 33 when the keypanel 13 is located in the extended secured horizontal position, as shown in FIG. 1. The support shoulder 33 extends across the length of the wall 19A along the bottom of the keybox 11, and is capable of supporting multiple keypanels 13 thereon.

The retaining bar 35 secures the upper edge 42 of the horizontally extended keypanel by being located in a notch 37 in the keypanel 13. Each keypanel 13 has a notch 37 located along its upper edge 42 when the keypanel 13 is laterally inserted into the horizontally oriented keybox 11 with the keyhooks 15 facing upwards. The notch 37 is located proximate to the back wall 21 of the keybox 11 when the keypanel 13 is fully inserted into the keybox 11 in its stowed position 14. The keypanel is fully exposed outside the opening 23 of the keybox 11 when the notch 37 is positioned to receive the retaining bar 35. The notch 37 is sized so that the retaining bar 35 fits easily into the notch 37, yet is not retained loosely by the notch 37.

As shown in FIGS. 1—3 and 6, the retaining bar 35 of the keybox 11 is pivotally mounted to the keybox 11 and extends across the opening 23 proximate to the edge of the wall 19B that defines the upper edge of the opening 23 of the horizontally oriented keybox 11. The retaining bar 35 is bent at each end so that the end portions 39 of the bar 35 extend transverse to the center portion 41 of the bar 35. The end portions 39 of the bar 35 are pivotally mounted to the outside of the side walls 19C, 19D of the keybox 11 with self locking nuts and bolts. The end portions 39 of the bar 35 extend from the pivotal mounts 43 forward to the center portion 41 of the bar 35. The center portion 41 of the bar 35 is integrally coupled between the end portions 39 slightly forward of the opening 23.

The center portion 41 of the bar 35 extends opposite the support shoulder 33 located along the bottom of the horizontally oriented keybox 11. The retaining bar 35 is located so that the center portion 41 of the bar 35 may be pivoted into the notch 37 of a keypanel 13 from above the keypanel 13 when the keypanel 13 is located on the support shoulder 33, thereby securing the keypanel in its extended horizontal position 12. The retaining bar 35 may also be pivoted out of the notch 37 of the keypanel 13 so that the keypanel may be relocated within the keybox 11 or removed from the keybox 11.

When the keybox 11 is located in its vertically oriented position with the opening 23 of the keybox 11 facing upwards each keypanel 13 may be located in a stable position extending vertically out of the keybox so that each keypanel 13 may be individually viewed. In the stable extended vertical position (not shown) a keypanel 13 is located on a supporting edge formed by an opposing pair of grooved tracks 26 and 27. As shown in FIG. 5, each grooved track 26 and 27 includes a widened section 47 located proximate to the opening 23 of the keybox 11. A ledge 49 is formed in the base of the widened section 47 in the grooved track 27. The ledges 49 of each opposing pair of grooved tracks 26 and 27 are located opposing each other. The opposing ledges 49 form the supporting edge upon which the bottom corners of the vertically oriented keypanel 13 may be placed. The keypanel 13 is tilted from its vertical orientation to locate a bottom edge of the keypanel on the ledges 49 in the tracks 26 and 27. The tilted keypanel is held in its vertically extended position by the ledges 49. The ledges 49 retain the keypanel 13 in an extended vertical position until the keypanel is removed from the ledges 49 and is slidably reinserted into the keybox 11 along the grooved tracks 26 and 27.

In a preferred embodiment, the keybox 11 is formed of steel. The side walls 19A–D and the back wall 21 of the keybox 11 are welded together about their edges. The side walls 19A–19D of the keybox 11 are 15½ inches long, 15½ inches wide, and 1/32 of an inch thick. The back wall 21 of the keybox has the same dimensions as the side walls 19A–19D. The opening 23 formed by the side walls 19A–19D is 15½ inches wide and 15½ inches long. The cavity 25 formed in the keybox 11 is 15½ inches long, 15½ inches wide and 15½ inches deep. The grooved tracks 26 and 27 in the keybox 11 extend from the opening 3½ inches towards the back wall 21. The grooved tracks 26 and 27 are ¼ of an inch wide, except at the widened sections, where the grooved track is ¾ of an inch wide along the ledge 49 formed in the grooved track 27. The ledge is ½ of an inch wide.

The retaining bar 35 is also formed of steel. The center portion 41 of the retaining bar 35 is 1/16 of an inch thick. The center portion 41 extends lengthwise between the side walls 19C and 19D of the keybox 11. The end portions 39 of the retaining bar 35 are 1 inch long, ½ of an inch wide, and 1/16 of an inch thick, where the end portions 39 extend ½ of an inch forward of the keybox opening 23 to the center portion 41 of the bar 35 when the end portions 39 are located perpendicular to the edges of the side walls 19C and 19D.

Each keypanel 13 is formed of steel. The keypanels 13 are 15 inches long, 15 inches wide, and approximately 1/32 of an inch thick. The notch 37 is located approximately 1 7/16 inches from a corner of the keypanel 13 and is 7/16 of an inch deep and 3/16 of an inch wide. The shoulders 31 and 36 of the keypanels 13 are formed by welding one face of a right angled plate to the keypanel 13 so that the other face of the plate forms the shoulder 31 or 36. The shoulders 31 and 36 are located ½ an inch inward from an edge of a keypanel 13. Each keyhook 15 is integrally coupled to the keypanel 13 and extends approximately 1¼ inches from the keypanel 13 and has a 3/8 of an inch hooked portion.

In a preferred embodiment, the keybox 11 is capable of receiving ten keypanels 13. Each keypanel has five rows of keyhooks 15, where each row includes ten keyhooks 15. Each keyhook 15 is capable of receiving several keys 17 thereon.

In operation, the keybox 11 may be used in its vertical orientation or its horizontal orientation in accordance with whichever is most convenient. In order to use the keybox in its horizontal orientation the keybox 11 is located with the opening 23 of the keybox 11 facing sidewards. The keypanels 13 are inserted into the keybox 11 so that the keyhooks 15 are located facing upwards and the notch 37 in the keypanel 13 is located along the upper edge 42 of the horizontally oriented keypanel 13. Opposing edges 29H of each keypanel 13 are located in an opposing pair of grooved tracks 26 and 27 and the keypanel 13 is slidably inserted into the cavity 25 of the keybox 11 along the tracks 26 and 27. Keys 17 may be placed on the keyhooks 15 of the keypanels 13 as needed.

To view the keys 17 located on a particular keypanel 13 in the horizontally oriented keybox 11 the keypanel 13 is secured in its extended horizontal position 12. The keypanel 13 is pulled out of the cavity 25 of the keybox 11 by grasping the shoulder 31 of the keypanel 13 and pulling the keypanel 13 along the grooved tracks 26 and 27. The keypanel 13 is located on the support shoulder 33 by removing the bottom edge 40 of the keypanel from the track 26 and placing the bottom rear corner of the keypanel 13 on the support shoulder 33. The upper edge 42 of the keypanel 13 is located within the track 27 so that the notch 37 is positioned to receive the retaining bar 35. The retaining bar 35 is then pivoted into the notch 37 of the keypanel 13 to secure the keypanel 13 between the retaining bar 35 and the support shoulder 33.

After viewing the keys 17 on the secured keypanel 13, the keypanel 13 is reinserted into the keybox 11 for storage. The retaining bar 35 is pivoted out of the notch 37 of the keypanel 13 to release the keypanel 13. The keypanel 13 is then removed from the support shoulder 33 and located with its bottom edge 40 in the grooved track 27. The keypanel 13 is then slid into the keybox 11 along the grooved tracks 27 until the keypanel 13 is located in its stowed position 14 in the keybox 11.

In order to use the keybox 11 in its vertical orientation the keybox 11 is located with the opening 23 of the keybox 11 facing upwards. The keypanels 13 are inserted into the keybox 11 so the keyhooks 15 are located facing upwards. Opposing edges 34V of each keypanel 13 are located in an opposing pair of grooved tracks 26 and 27 and the keypanel 13 is slidably inserted into the cavity 25 of the keybox 11 along the tracks 27 into a stowed position. Keys 17 may be placed on the keyhooks 15 of the keypanels 13 as needed.

To view the keys 17 located on a particular keypanel 13 in the vertically oriented keybox 11 the keypanel 13 is secured in its extended vertical position. The keypanels are secured in an extended vertical position in the same manner that keypanels are secured in an extended vertical position in conventional, commercially available keyboxes. The keypanel 13 is pulled upwards out of the cavity 25 by grasping the shoulder 36 of the keypanel 13 and pulling the keypanel 13 along the grooved tracks 26 and 27. The keypanel 13 is held in an extended vertical position by tilting the keypanel and placing the bottom rear corners of the keypanel 13 on the ledges 49 formed in the opposing grooved tracks 26 and 27. To return the keypanel 13 into the cavity 25, the keypanel 13 is lifted off of the ledges 49 and reinserted into the cavity 25 along the grooved tracks 26 and 27.

The keybox 11 is easily changed between its horizontal orientation and its vertical orientation, and vice versa. In order to change between the horizontal and vertical orientations, first the keypanels 13 are removed from the keybox 11. The keybox 11 is then located in the desired orientation, the opening 23 facing upwards to locate the keybox in a vertical orientation, or the opening 23 facing sidewards to locate the keybox in a horizontal orientation. The keypanels 13 are then reinserted into the grooved tracks 26 and 27 of the keybox along the edges 29H or 34V so that the keyhooks 15 are located facing upwards.

The foregoing disclosure and the showings made in the drawings are merely illustrative of the principles of this invention and are not to be interpreted in a limiting sense.

I claim:

1. An apparatus for retaining a plurality of keys, comprising:

an open-faced box having walls which form a cavity therebetween, said walls defining an opening that communicates with said cavity;

at least one keypanel removably mounted in a stowed position within said cavity of said box;

a shoulder extending along one of said walls of said box adjacent said opening, said shoulder being structured and arranged to support a first portion of each keypanel located in an extended position extending out of said box through said opening;

a stop coupled to another of said walls of said box, said stop being opposite of said one wall with said shoulder and being structured and arranged to engage and hold a second portion of each keypanel located in an extended position;

a plurality of keyhooks coupled to and extending from each keypanel, said keyhooks being capable of receiving and retaining keys thereon.

2. The apparatus for retaining keys of claim 1, wherein each keypanel is square, where each keypanel has a first pair of opposing edges and a second pair of opposing edges, each keypanel being structured and arranged to be mounted in said box on one of either its first pair of opposing edges or its second pair of opposing edges.

3. The apparatus for retaining keys of claim 2, wherein:

each keypanel is mounted on one pair of opposing edges in opposing grooved tracks in said box.

4. The apparatus for retaining keys of claim 3, wherein:

a supporting ledge is formed in said box by a widened section of each opposing grooved track.

5. The apparatus for retaining keys of claim 1, further comprising:

a plurality of pairs of opposing grooved tracks for slidably mounting each keypanel in said box, where said grooved tracks extend through opposing plates mounted along opposing walls of said box adjacent to said cavity.

6. The apparatus for retaining keys of claim 5, wherein:

said extended position of each keypanel comprises a first extended position;

each of said grooved tracks has a widened section, where said widened section of each grooved track forms a supporting ledge in a plate, where supporting ledges formed in opposing plates by an opposing pair of grooved tracks are structured and arranged to maintain a keypanel in a second extended position extending out of said box.

7. The apparatus for retaining keys of claim 1, wherein:

a plurality of keypanels are removably mounted in said cavity of said box.

8. An apparatus for retaining a plurality of keys, comprising:

an open-faced box having walls which form a cavity therebetween, said walls defining an opening that communicates with said cavity;

at least one keypanel removably mounted in a stowed position within said cavity of said box;

a shoulder extending along a wall of said box adjacent said opening, said shoulder being structured and arranged to support a first portion of each keypanel located in an extended position extending out of said box;

each keypanel has a notch along an edge at a second portion;

a retaining bar coupled to said box extending along a wall of said box located opposite said shoulder, said retaining bar being structured and arranged to he received within each notch of each extended keypanel so that said retaining bar and said shoulder cooperatively maintain each extended key panel in an extended position;

a plurality of keyhooks coupled to and extending from each keypanel, said keyhooks being capable of receiving retaining keys thereon.

9. The apparatus for retaining keys of claim 8, wherein:

said retaining bar is pivotally mounted to said box so that said retaining bar may be pivoted into said notch of each keypanel.

10. An apparatus for retaining a plurality of keys, comprising:

an open-faced box having walls which form a cavity therebetween, said walls defining an opening that communicates with said cavity;

a plurality of keypanels removably mounted in said cavity of said box;

a shoulder extending along a wall of said box adjacent said opening, said shoulder being structured and arranged to support a first corner of each keypanel located in a first extended position extending out of said box;

a plurality of keyhooks coupled to and extending from each keypanel, said keyhooks being capable of receiving and retaining keys thereon;

each of said keypanels is square, having a first pair of opposing edges with which each of said keypanels may be mounted in said box and a second pair of opposing edges with which each of said keypanels may be mounted in said box; each of said keypanels are slidably mounted in said box on one of either of said first pair of opposing edges or said second pair of opposing edges;

each keypanel has a notch along an edge at a second corner;

a retaining bar coupled to said box extending along a wall of said box located opposite said shoulder, said retaining bar being structured and arranged to be received within each notch of each extended keypanel so that said retaining bar said shoulder cooperatively maintain each extended keypanel in said first extended position;

said retaining bar is pivotally mounted to said box so that said retaining bar may be pivoted into each notch of each extended keypanel;

a plurality of pairs of opposing grooved tracks are located in said box for slidably mounting each keypanel in said box, where said grooved tracks extend through opposing plates mounted along opposing walls of said box adjacent said cavity;

said extended position of each keypanel comprises first extended position;

each of said grooved tracks has a widened section where said widened section of each grooved track forms supporting ledge in a plate, where supporting ledges formed in opposing plates by an opposing pair of grooved tracks are structured and arranged to maintain a keypanel in a second extended position extending out of said box through said opening.

11. A method of providing access to keys in a keybox, comprising the steps of:

providing a keybox having a cavity located therein and a sidewardly facing opening accessing said cavity; a plurality of notched keypanels slidably mounted in said cavity, each keypanel having a plurality of keyhooks for retaining keys thereon; a pivotally mounted retaining bar located along an upper edge of said opening; and a shoulder located along a lower edge of said opening;

sliding a keypanel out of said cavity through said sidewardly facing opening by pulling said keypanel through said opening;

locating said keypanel in a stable accessible position by locating a lower edge of said keypanel on said shoulder;

securing said keypanel in said stable accessible position by pivoting said retaining bar into a notch in an upper edge of said keypanel, thereby securing said upper edge.

* * * * *